US007875132B2

(12) United States Patent
Pandey

(10) Patent No.: US 7,875,132 B2
(45) Date of Patent: Jan. 25, 2011

(54) HIGH TEMPERATURE ALUMINUM ALLOYS

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 879 days.

(21) Appl. No.: 11/141,625

(22) Filed: May 31, 2005

(65) Prior Publication Data

US 2006/0269437 A1 Nov. 30, 2006

(51) Int. Cl.
*C22C 21/00* (2006.01)

(52) U.S. Cl. ..... 148/415; 420/551

(58) Field of Classification Search ..... 148/415, 148/416, 417; 420/551
See application file for complete search history.

(56) References Cited

U.S. PATENT DOCUMENTS

| | | | | |
|---|---|---|---|---|
| 3,619,181 | A | 11/1971 | Willey | |
| 4,689,090 | A | 8/1987 | Sawtell et al. | |
| 4,874,440 | A * | 10/1989 | Sawtell et al. | 148/437 |
| 5,130,209 | A * | 7/1992 | Das et al. | 428/614 |
| 5,597,529 | A | 1/1997 | Tack | |
| 5,620,652 | A | 4/1997 | Tack et al. | |
| 5,624,632 | A | 4/1997 | Baumann et al. | |
| 6,139,653 | A | 10/2000 | Fernandes et al. | |
| 6,248,453 | B1 | 6/2001 | Watson | |
| 6,258,318 | B1 | 7/2001 | Lenczowski et al. | |
| 6,315,948 | B1 | 11/2001 | Lenczowski et al. | |
| 6,506,503 | B1 | 1/2003 | Mergen et al. | |
| 6,531,004 | B1 | 3/2003 | Lenczowski et al. | |
| 6,974,510 | B2 * | 12/2005 | Watson | 148/437 |
| 2004/0055671 | A1 | 3/2004 | Olson et al. | |

FOREIGN PATENT DOCUMENTS

| | | | |
|---|---|---|---|
| EP | 1111079 | A | 6/2001 |
| EP | 1439239 | A | 7/2004 |
| EP | 1471157 | A | 10/2004 |
| RU | 2001144 | C1 * | 10/1993 |
| RU | 2001145 | C1 | 10/1993 |
| WO | WO 91/10755 | A | 7/1991 |
| WO | WO 03/052154 | A | 6/2003 |
| WO | WO 03/104505 | A | 12/2003 |
| WO | WO 2005/045080 | A | 5/2005 |

OTHER PUBLICATIONS

"Aluminum and Aluminum Alloys", ASM International, 1993, p. 559.*

* cited by examiner

*Primary Examiner*—Roy King
*Assistant Examiner*—Janelle Morillo
(74) *Attorney, Agent, or Firm*—Kinney & Lange, P.A.

(57) ABSTRACT

High temperature aluminum alloys that can be used at temperatures from about −420° F. (−251° C.) up to about 650° F. (343° C.) are described herein. These alloys comprise aluminum; scandium; at least one of nickel, iron, chromium, manganese and cobalt; and at least one of zirconium, gadolinium, hafnium, yttrium, niobium and vanadiuim. These alloys comprise an aluminum solid solution matrix and a mixture of various dispersoids. These alloys are substantially free of magnesium.

40 Claims, 3 Drawing Sheets

HIGH TEMPERATURE ALUMINUM ALLOYS

STATEMENT REGARDING FEDERALLY SPONSORED RESEARCH OR DEVELOPMENT

The U.S. Government may have certain rights to some embodiments of this invention pursuant to Contract Number FA8650-05-C-5804 between the United States Air Force and United Technologies Corporation, Pratt & Whitney, and pursuant to Small Business Innovative Research Contract Number F04611-03-M-3030 (Phase I) between the United States Air Force and DWA Aluminum Composites.

FIELD OF THE INVENTION

The present invention relates generally to aluminum alloys, and more specifically, to aluminum alloys that are useful for applications at temperatures from about −420° F. (−251° C.) up to about 650° F. (343° C.).

BACKGROUND OF THE INVENTION

Aluminum alloys are used in aerospace and space applications because of their high strength, high ductility, high fracture toughness and low density. However, aluminum alloys are typically limited to use below about 250° F. (121° C.) because above that temperature most aluminum alloys lose their strength due to rapid coarsening of strengthening precipitates therein.

Considerable effort has been made to increase the temperature capability of aluminum alloys. Some attempts have included using aluminum-iron and aluminum-chromium based alloys, such as Al—Fe—Ce, Al—Fe—V—Si, Al—Fe—Ce—W, and Al—Cr—Zr—Mn, that contain incoherent dispersoids. However, the strength of these alloys degrades at higher temperatures due to coarsening of the incoherent dispersoids. Furthermore, these alloys have lower ductility and fracture toughness than other commercially available aluminum alloys.

Other attempts have included using aluminum alloys such as Al—Mg and Al—Ti that are strengthened by incoherent oxide particles. While these alloys have promising strength at high temperatures, they have lower ductility and fracture toughness than other commercially available aluminum alloys.

Yet other attempts have included using Al—Sc based alloys that contain low volume fractions of strengthening coherent dispersoids. However, since these Al—Sc based alloys were developed to obtain improved superplasticity (which requires lower flow stress at high temperatures), they are not suitable for providing high temperature strength (which would require much higher flow stress at high temperatures) at temperatures up to about 650° F. (343° C.).

Still other attempts have included using Al—Sc based alloys that contain gadolinium and/or zirconium, and preferably magnesium too. While these alloys have good ductility and fracture toughness, they are only useful at temperatures up to about 573° F. (300° C.).

Existing aluminum alloys lack the desired strength, ductility and fracture toughness that are needed for many applications at temperatures up to about 650° F. (343° C.). Therefore, it would be desirable to have aluminum alloys that have the desired strength, ductility and fracture toughness that are needed for various applications at temperatures from about −420° F. (−251° C.) up to about 650° F. (343° C.).

SUMMARY OF THE INVENTION

Accordingly, the above-identified shortcomings of existing aluminum alloys are overcome by embodiments of the present invention, which relates to aluminum alloys that have superior strength, ductility and fracture toughness at temperatures from about −420° F. (−251° C.) up to about 650° F. (343° C.).

The aluminum alloys of this invention comprise: (a) about 0.6-2.9 weight percent scandium; (b) at least one of: about 1.5-25 weight percent nickel, about 1.5-20 weight percent iron, about 1-18 weight percent chromium, about 1.5-25 weight percent manganese, and about 1-25 weight percent cobalt; (c) at least one of: about 0.4-2.9 weight percent zirconium, about 0.4-20 weight percent gadolinium, about 0.4-30 weight percent hafnium, about 0.4-30 weight percent yttrium, about 0.3-10 weight percent niobium, and about 0.2-10 weight percent vanadium; and (d) the balance substantially all aluminum.

Embodiments of this invention also comprise aluminum alloys comprising (a) about 0.6-2.9 weight percent scandium; (b) about 1.5-25 weight percent nickel; (c) at least one of: about 0.4-20 weight percent gadolinium, about 0.4-2.9 weight percent zirconium, about 0.4-30 weight percent hafnium, about 0.3-10 weight percent niobium, about 0.2-10 weight percent vanadium, and about 0.4-30 weight percent yttrium; and (d) the balance substantially aluminum.

Embodiments of this invention also comprise aluminum alloys comprising (a) about 1-2.9 weight percent scandium; (b) about 6-10 weight percent nickel; (c) at least one of: about 2-10 weight percent gadolinium, about 0.5-2.9 weight percent zirconium, about 6-12 weight percent hafnium, about 1-6 weight percent niobium, about 1-5 weight percent vanadium, and about 1-8 weight percent yttrium; and (d) the balance substantially aluminum.

Embodiments of this invention also comprise aluminum alloys comprising (a) about 2.15 weight percent scandium; (b) about 8.4 weight percent nickel; (c) at least one of: about 4.1-8.8 weight percent gadolinium, about 1.5-2.5 weight percent zirconium, about 8.0-11.5 weight percent hafnium, about 2.5-5.0 weight percent niobium, about 2.0-3.2 weight percent vanadium, and about 2.5-6.5 weight percent yttrium; and (d) the balance substantially aluminum.

These alloys are substantially free of magnesium, and comprise an aluminum solid solution matrix and a plurality of dispersoids. The dispersoids may comprise $Al_3Ni$, $Al_3Fe$, $Al_6Fe$, $Al_7Cr$, $Al_6Mn$, $Al_9Co_2$, and/or $Al_3X$. Each $Al_3X$ dispersoid has an $L1_2$ structure where X comprises scandium and at least one of: zirconium, gadolinium, hafnium, yttrium, niobium and vanadium.

Further features, aspects and advantages of the present invention will be readily apparent to those skilled in the art during the course of the following description, wherein references are made to the accompanying figures which illustrate some preferred forms of the present invention, and wherein like characters of reference designate like parts throughout the drawings.

DESCRIPTION OF THE DRAWINGS

Embodiments of the present invention are described herein below with reference to various figures, in which.

DETAILED DESCRIPTION OF THE INVENTION

Figure 1:
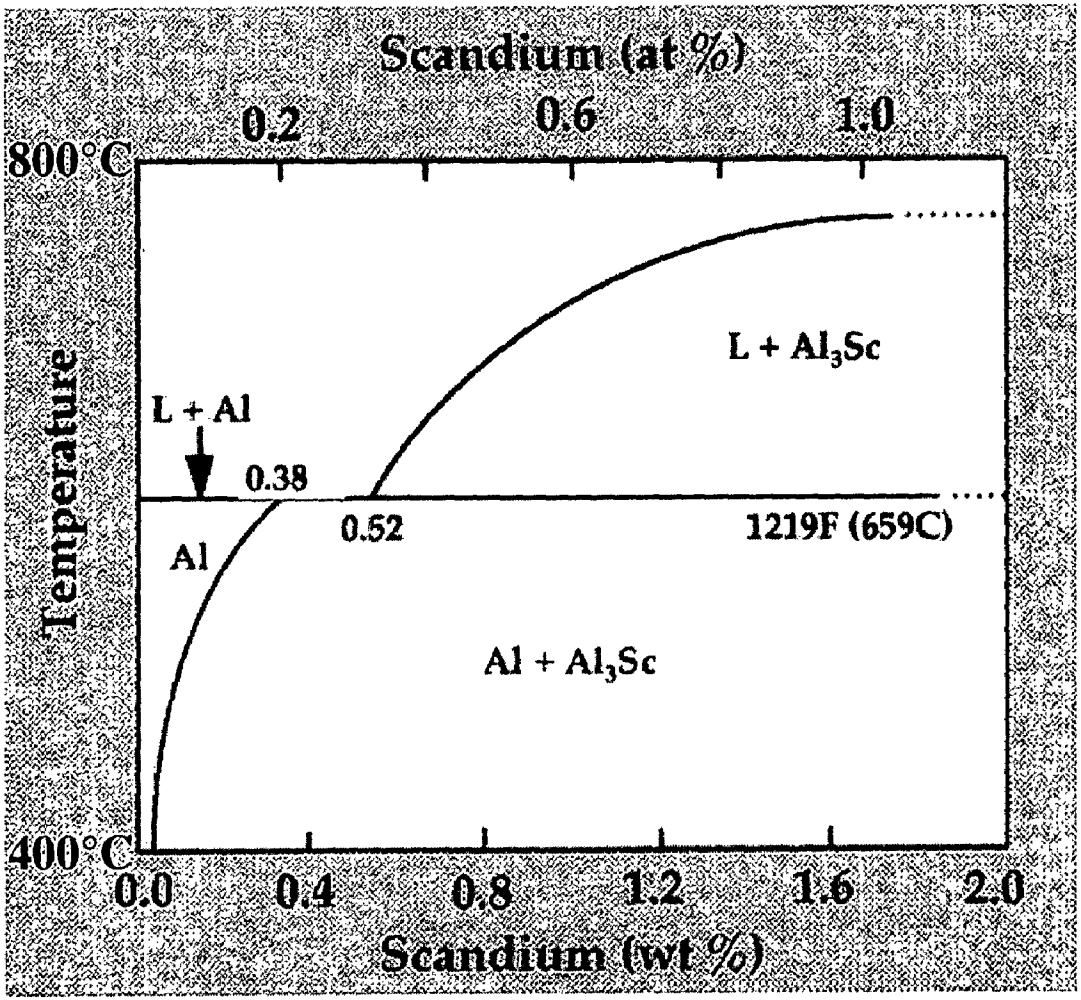
FIG. 1 is a phase diagram of Al—Sc.
Figure 2:
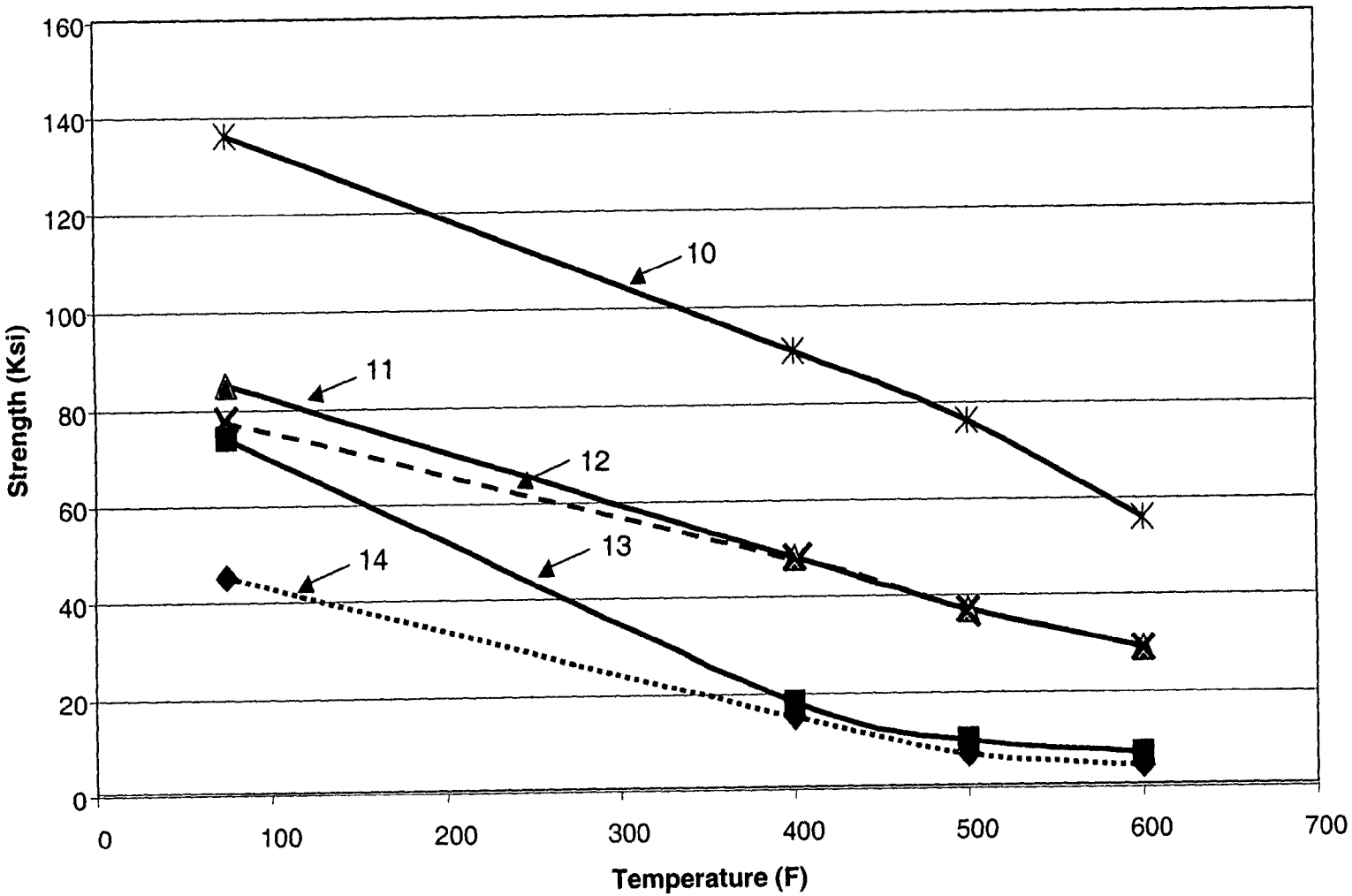
FIG. 2 is a graph showing strength versus temperature for a variety of aluminum alloys.
Figure 3:
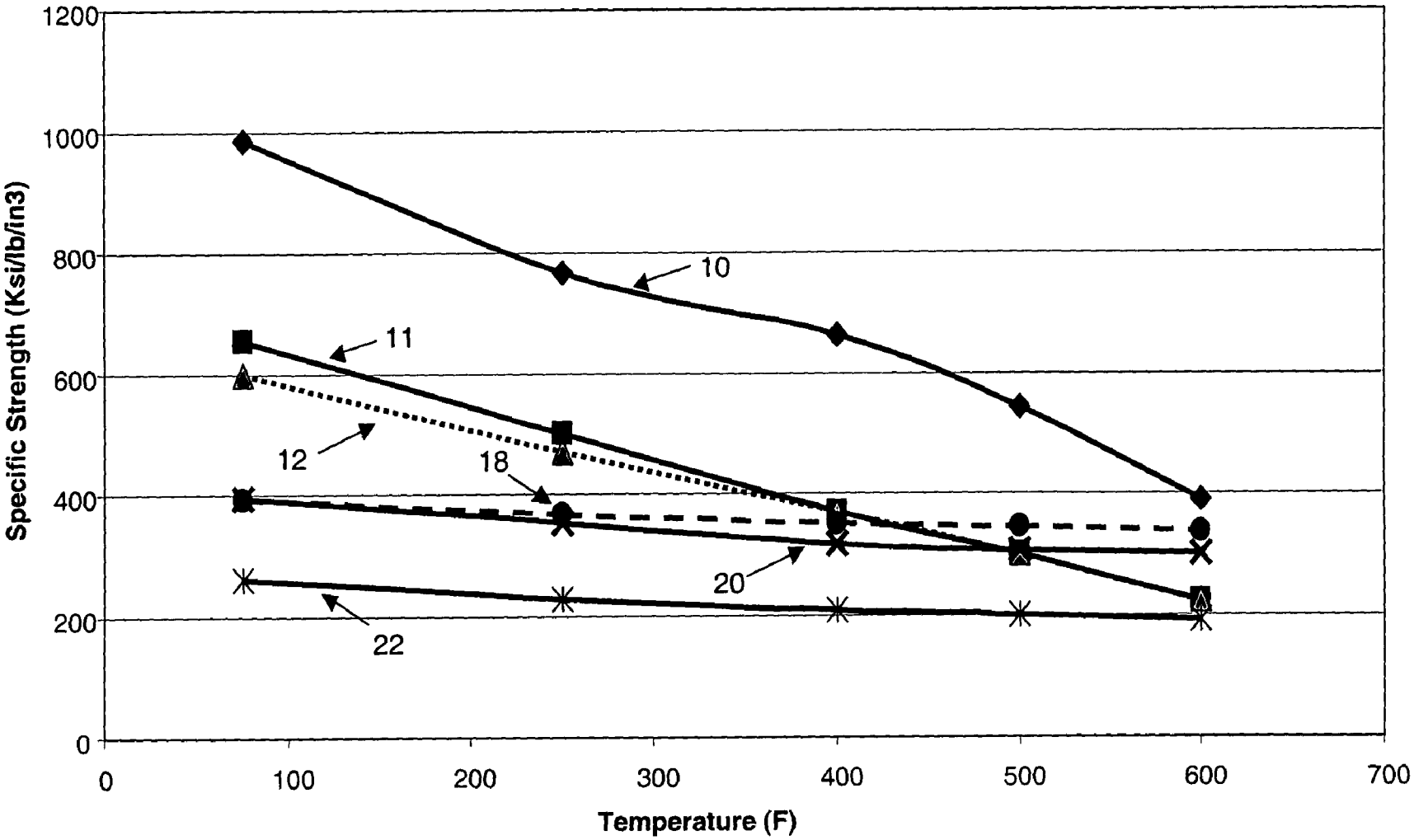
FIG. 3 is a graph showing specific strength versus temperature for a variety of materials.

For the purposes of promoting an understanding of the invention, reference will now be made to some embodiments of this invention as illustrated in FIGS. 1-3 and specific language used to describe the same. The terminology used herein is for the purpose of description, not limitation. Specific structural and functional details disclosed herein are not to be interpreted as limiting, but merely as a basis for teaching one skilled in the art to variously employ the present invention. Any modifications or variations in the depicted embodiments, and such further applications of the principles of the invention as illustrated herein, as would normally occur to one skilled in the art, are considered to be within the spirit and scope of this invention as described and claimed.

When referring to numerical ranges of values, such ranges include each and every number and/or fraction thereof at and between and about the stated range minimum and maximum. For example, a range of about 0.1-1.0 weight percent element A includes all intermediate values of about 0.6, about 0.7 and about 0.8 weight percent element A, all the way up to and including about 0.98, about 0.99, about 0.995 and about 1.0 weight percent element A, etc. This applies to all the numerical ranges of values for all elements and/or compositions discussed herein.

As used herein and throughout, "substantially free" means having no significant amount of an element or composition purposely added to the alloy composition, it being understood that trace amounts of incidental elements and/or impurities may be present in a desired end product.

This invention relates to aluminum alloys that have superior strength, ductility and fracture toughness for applications at temperatures from about −420° F. (−251° C.) up to about 650° F. (343° C.). These aluminum alloys comprise alloying elements that have been selected because they have low diffusion coefficients in aluminum, they have low solid solubilities in aluminum, and they can form dispersoids that have low interfacial energies with aluminum. Solid solution alloying is beneficial because it provides additional strengthening and greater work hardening capability, which results in improved failure strain and toughness. The alloys of this invention comprise aluminum; scandium; at least one of nickel, iron, chromium, manganese and cobalt; and at least one of zirconium, gadolinium, hafnium, yttrium, niobium and vanadium. These alloys comprise an aluminum solid solution matrix with a mixture of dispersoids therein. These dispersoids comprise $Al_3X$ dispersoids having an $Ll_2$ structure, where X comprises scandium and at least one of zirconium, gadolinium, hafnium, yttrium, niobium and vanadium. These alloys also comprise dispersoids of $Al_3Ni$, $Al_3Fe$, $Al_6Fe$, $Al_7Cr$, $Al_6Mn$ and/or $Al_9CO_2$, which are different than the $Ll_2$ dispersoids. Unlike many existing Al—Sc based alloys, these alloys are substantially free of magnesium, and instead comprise at least one of iron, chromium, manganese, cobalt, or preferably nickel, which provide solid solution strengthening that is more thermally stable at high temperatures.

The aluminum alloys of this invention comprise: (a) about 0.6-2.9 weight percent scandium; (b) at least one of: about 1.5-25 weight percent nickel, about 1.5-20 weight percent iron, about 1-18 weight percent chromium, about 1.5-25 weight percent manganese, and about 1-25 weight percent cobalt; (c) at least one of: about 0.4-2.9 weight percent zirconium, about 0.4-20 weight percent gadolinium, about 0.4-30 weight percent hafnium, about 0.4-30 weight percent yttrium, about 0.3-10 weight percent niobium, and about 0.2-10 weight percent vanadium; and (d) the balance substantially aluminum. In the balance that is substantially aluminum, there may also be some minor amounts of impurities or other materials and/or elements that do not materially affect the basic and novel characteristics of the alloy.

One exemplary, non-limiting aluminum alloy of this invention comprises about 0.6-2.9 weight percent scandium, about 1.5-25 weight percent nickel, about 0.4-20 weight percent gadolinium, and about 0.4-2.9 weight percent zirconium. This alloy may also comprise about 0.4-30 weight percent hafnium, about 0.4-30 weight percent yttrium, about 0.3-10 weight percent niobium, or about 0.2-10 weight percent vanadium, or combinations thereof, in addition to gadolinium and zirconium, or in place of gadolinium or zirconium or both. Additionally, about 1.5-20 weight percent iron, about 1.0-18 weight percent chromium, about 1.5-25 weight percent manganese, or about 1.0-25 weight percent cobalt, or combinations thereof, can be used in place of, or in addition to, nickel.

Other exemplary aluminum alloys of this invention include, but are not limited to (in weight percent):

about Al-(6-10)Ni-(1-2.9)Sc-(6-10)Gd-(0.5-2.9)Zr;
about Al-(6-10)Ni-(1-2.9)Sc-(6-10)Gd-(1-4)Y;
about Al-(6-10)Ni-(1-2.9)Sc-(2-6)Gd-(4-8)Y;
about Al-(6-10)Ni-(1-2.9)Sc-(6-12)Hf-(0.5-2.9)Zr;
about Al-(6-10)Ni-(1-2.9)Sc-(6-12)Hf-(3-7)Gd;
about Al-(6-10)Ni-(1-2.9)Sc-(6-12)Hf-(2-6)Y;
about Al-(6-10)Ni-(1-2.9)Sc-(4-9)Y-(0.5-2.9)Zr;
about Al-(6-10)Ni-(1-2.9)Sc-(1-6)Nb-(0.5-2.9)Zr;
about Al-(6-10)Ni-(1-2.9)Sc-(6-12)Hf-(1-6)Nb;
about Al-(6-10)Ni-(1-2.9)Sc-(6-12)Hf-(1-5)V;
about Al-(6-1O)Ni-(1-2.9)Sc-(1-6)Nb-(1-5)V; and
about Al-(6-10)Ni-(1-2.9)Sc-(0.5-2.9)Zr-(1-5)V.

Even more specifically, other exemplary aluminum alloys of this invention include, but are not limited to (in weight percent):

about Al-8.4Ni-2.15Sc-8.8Gd-2.5Zr;
about Al-8.4Ni-2.15Sc-8.8Gd-1.5Zr;
about Al-8.4Ni-2.15Sc-4.1Gd-5.4Y;
about Al-8.4Ni-2.15Sc-8.5Gd-2.5Y;
about Al-8.4Ni-2.15Sc-11.5Hf-1.5Zr;
about Al-8.4Ni-2.15Sc-9.8Hf-1.5Zr;
about Al-8.4Ni-2.15Sc-9.0Hf-4.5Gd;
about Al-8.4Ni-2.15Sc-8.5Hf-3.0Y;
about Al-8.4Ni-2.15Sc-6.5Y-1.5Zr;
about Al-8.4Ni-2.15Sc-5.0Nb-2.1Zr;
about Al-8.4Ni-2.15Sc-9.5Hf-2.5Nb;
about Al-8.4Ni-2.15Sc-8.0Hf-2.0V;
about Al-8.4Ni-2.15Sc-2.5Nb-3.2V; and
about Al-8.4Ni-2.15Sc-2.5Zr-3.2V.

Scandium is a potent strengthener in aluminum alloys, and has low diffusivity and low solubility in aluminum. Scandium forms $Al_3Sc$ dispersoids in the aluminum. The $Al_3Sc$ dispersoids have an $Ll_2$ structure that is an ordered face centered cubic structure with scandium atoms located at the corners and aluminum atoms located on the cube faces. The $Al_3Sc$ dispersoids are fine and coherent with the aluminum matrix. The lattice parameters of aluminum and $Al_3Sc$ are very close, 0.405 nm and 0.410 nm respectively, indicating that there is minimal or no driving force for causing growth of the $Al_3Sc$ dispersoids. This low interfacial energy makes the $Al_3Sc$ dispersoids thermally stable and resistant to coarsening up to temperatures as high as about 842° F. (450° C.). In the alloys of this invention, these $Al_3Sc$ dispersoids are made stronger and more resistant to coarsening at elevated temperatures by adding suitable alloying elements, such as gadolinium, zirconium, hafnium, yttrium, niobium, or vanadium, or combinations thereof.

Gadolinium forms $Al_3Gd$ dispersoids in the aluminum that are stable up to temperatures as high as about 842° F. (450° C.) due to their low diffusivity in aluminum. The $Al_3Gd$ dispersoids have a $DO_{19}$ structure in the equilibrium condition. Despite its large atomic size, gadolinium has fairly high solubility in $Al_3Sc$. Gadolinium can substitute with scandium in $Al_3Sc$, thereby forming an ordered $Ll_2$ phase of $Al_3(Sc_x, Gd_{1-x})$ dispersoids, which results in improved thermal and structural stability.

Zirconium forms $Al_3Zr$ dispersoids in the aluminum that have an $Ll_2$ structure in the metastable condition and a $DO_{23}$ structure in the equilibrium condition. The $Al_3Zr$ dispersoids have a low diffusion coefficient, which makes them thermally stable and highly resistant to coarsening. Similarity in the nature of $Al_3Zr$ and $Al_3Sc$ dispersoids allow at least partial intersolubility of these phases, thereby resulting in an ordered $Ll_2$ $Al_3(Sc_x,Zr_{1-x})$ phase. Substituting zirconium for scandium in the $Al_3Sc$ dispersoids allows stronger and more thermally stable $Ll_2$ $Al_3(Sc_x,Zr_{1-x})$ dispersoids to form.

The thermal and structural stability of the $Al_3Sc$ dispersoids can be increased by adding both gadolinium and zirconium. The Al—Sc—Gd—Zr alloy forms an ordered $Ll_2$ $Al_3$ (Sc,Gd,Zr) phase having improved thermal and structural stability, which is believed to be due to the reduced lattice mismatch between the aluminum matrix and the dispersoids. Furthermore, the modified $Al_3$(Sc,Gd,Zr) dispersoids are stronger than the $Al_3Sc$ dispersoids, thereby improving the mechanical properties of the alloy at temperatures from about −420° F. (−251° C.) up to about 650° F. (343° C.).

While gadolinium and zirconium are preferred in some embodiments, other elements, such as hafnium, yttrium, vanadium or niobium, either individually or in combination, can be used in place of either one or both of gadolinium and zirconium, or in combination with gadolinium and zirconium. Some embodiments may comprise both gadolinium and zirconium, other embodiments may comprise gadolinium but no zirconium, other embodiments may comprise zirconium but no gadolinium, and yet other embodiments may comprise neither gadolinium nor zirconium.

Hafnium forms $Al_3Hf$ dispersoids in the aluminum that have an $Ll_2$ structure in the metastable condition and a $DO_{23}$ structure in the equilibrium condition. The $Al_3Hf$ dispersoids have a low diffusion coefficient, which makes them thermally stable and highly resistant to coarsening. Hafnium has a high solubility in the $Al_3Sc$ dispersoids, allowing large amounts of hafnium to substitute for scandium in the $Al_3Sc$ dispersoids, which results in stronger and more thermally stable $Al_3(Sc_x, Hf_{1-x})$ dispersoids.

Yttrium forms $Al_3Y$ dispersoids in the aluminum that have an $Ll_2$ structure in the metastable condition and a $DO_{19}$ structure in the equilibrium condition. The $Al_3Y$ dispersoids have a low diffusion coefficient, which makes them thermally stable and highly resistant to coarsening. Yttrium has a high solubility in the $Al_3Sc$ dispersoids, allowing large amounts of yttrium to substitute for scandium in the $Al_3Sc$ dispersoids, which results in stronger and more thermally stable $Al_3(Sc_x, Y_{1-x})$ dispersoids.

Vanadium forms $Al_3V$ dispersoids in the aluminum that have an $Ll_2$ structure in the metastable condition and a $DO_{22}$ structure in the equilibrium condition. The $Al_3V$ dispersoids have a low diffusion coefficient, which makes them thermally stable and highly resistant to coarsening. Vanadium has a lower solubility in the $Al_3Sc$ dispersoids than hafnium and yttrium, allowing relatively smaller amounts of vanadium than hafnium or yttrium to substitute for scandium in the $Al_3Sc$ dispersoids. Nonetheless, vanadium can be very effective in slowing down the coarsening kinetics of the $Al_3Sc$ dispersoids because the $Al_3V$ dispersoids are thermally stable. The substitution of vanadium for scandium in the $Al_3Sc$ dispersoids results in stronger and more thermally stable $Al_3(Sc_x,V_{1-x})$ dispersoids.

Niobium forms $Al_3Nb$ dispersoids in the aluminum that have an $Ll_2$ structure in the metastable condition and a $DO_{22}$ structure in the equilibrium condition. Niobium has a lower solubility in the $Al_3Sc$ dispersoids than hafnium, yttrium, and vanadium, allowing relatively lower amounts of niobium than hafnium, yttrium or vanadium to substitute for scandium in the $Al_3Sc$ dispersoids. Nonetheless, niobium can be very effective in slowing down the coarsening kinetics of the $Al_3Sc$ dispersoids because the $Al_3Nb$ dispersoids are thermally stable. The substitution of niobium for scandium in the $Al_3Sc$ dispersoids results in stronger and more thermally stable $Al_3(Sc_x,Nb_{1-x})$ dispersoids.

Alloying elements, such as nickel, iron, chromium, manganese or cobalt, or combinations thereof, may also be added to derive dispersion and/or solid solution strengthening that are thermally stable at high temperatures. In embodiments, nickel may be added because it forms thermally stable spherical $Al_3Ni$ dispersoids, and in powder form nickel can be undercooled to relatively large levels (as compared to iron, chromium, manganese and cobalt) by controlling the powder processing parameters. While nickel is preferred in some embodiments, other elements, such as iron, chromium, manganese or cobalt, or combinations thereof, can be used in place of, or in addition to, nickel.

Nickel forms an eutectic with aluminum, resulting in a mixture of a solid solution of nickel in aluminum and $Al_3Ni$ dispersoids. Nickel is added to the alloys of this invention for two reasons. First, solid solution strengthening is derived from the nickel. Second, the $Al_3Ni$ dispersoids help dispersion strengthen the alloy. The aluminum solid solution and $Al_3Ni$ dispersoids are thermally stable, which contributes to the high temperature strengthening of the alloys. The solid solubility of nickel in aluminum can be increased significantly by utilizing rapid solidification processing.

Iron forms $Al_3Fe$ dispersoids and a solid solution of iron in aluminum. Iron is added to the alloys of this invention for two reasons. First, solid solution strengthening is derived from the iron. Second, the $Al_3Fe$ dispersoids help dispersion strengthen the alloy. The aluminum solid solution and $Al_3Fe$ dispersoids are thermally stable, which contributes to the high temperature strengthening of the alloys. The solid solubility of iron in aluminum can be increased significantly by utilizing rapid solidification processing.

Chromium forms $Al_7Cr$ dispersoids and a solid solution of chromium in aluminum. Chromium is added to the alloys of this invention for two reasons. First, solid solution strengthening is derived from the chromium. Second, the $Al_7Cr$ dispersoids help dispersion strengthen the alloy. The aluminum solid solution and $Al_7Cr$ dispersoids are thermally stable, which contributes to the high temperature strengthening of the alloys. The solid solubility of chromium in aluminum can be increased significantly by utilizing rapid solidification processing.

Manganese forms $Al_6Mn$ dispersoids and a solid solution of manganese in aluminum. Manganese is added to the alloys of this invention for two reasons. First, solid solution strengthening is derived from the manganese. Second, the $Al_6Mn$ dispersoids help dispersion strengthen the alloy. The aluminum solid solution and $Al_6Mn$ dispersoids are thermally stable, which contributes to the high temperature strengthening of the alloys. The solid solubility of manganese in aluminum can be increased significantly by utilizing rapid solidification processing.

Cobalt forms $Al_9Co_2$ dispersoids and a solid solution of cobalt in aluminum. Cobalt is added to the alloys of this invention for two reasons. First, solid solution strengthening is derived from the cobalt. Second, the $Al_9Co_2$ dispersoids help dispersion strengthen the alloy. The aluminum solid solution and $Al_9Co_2$ dispersoids are thermally stable, which contributes to the high temperature strengthening of the alloys. The solid solubility of cobalt in aluminum can be increased significantly by utilizing rapid solidification processing.

While nickel, iron, chromium, manganese and cobalt all have relatively low diffusion coefficients in aluminum, nickel may be desirable in some embodiments because it can form thermally stable spherical $Al_3Ni$ dispersoids, which provide superior high temperature strength and higher ductility than other alloys containing $Al_3Fe$, $Al_6Fe$, $Al_7Cr$, $Al_6Mn$ and/or $Al_9Co_2$ dispersoids.

The amount of scandium present in the alloys of this invention may vary from about 0.6 to about 2.9 weight percent, depending on the processing technique used for producing the material. As shown in FIG. 1, the phase diagram of Al—Sc indicates an eutectic reaction at about 0.5 weight percent scandium at about 1219° F. (659° C.), resulting in a solid solution of scandium in aluminum and $Al_3Sc$ dispersoids. The phase diagram also shows a steep liquidus for hypereutectic compositions (i.e., compositions comprising greater than about 0.5 weight percent scandium). This suggests that casting techniques can be used for scandium compositions comprising only about 0.5 weight percent scandium or less. For hypereutectic compositions, rapid solidification techniques such as melt spinning, atomization, spray deposition, vacuum plasma spraying, cold spraying, cryomilling, high energy ball milling, or other techniques utilizing higher cooling rates may need to be used to process the material. The amount of scandium that can be taken in supersaturation also depends upon the cooling rate. Ideally, all the scandium would be kept in solution to avoid the formation of primary particles, which are usually large in size and therefore, are not considered to be beneficial for mechanical properties. The upper limit of about 2.9 weight percent scandium was selected because atomization, the most common processing technique, can provide complete supersaturation of scandium in aluminum only up to about 3 weight percent scandium.

The amount of gadolinium present in the alloys of this invention, if any, may vary from about 0.4 to about 20 weight percent. The amount of gadolinium present depends on the solubility of gadolinium in the $Al_3Sc$ dispersoids. In embodiments, the atomic percents of gadolinium and scandium may be equivalent so that gadolinium can substitute up to about 50% in $Al_3(Sc_x,Gd_{1-x})$ dispersoids. Gadolinium also forms a solid solution of gadolinium in aluminum. Since Al—Gd forms an eutectic at about 23 weight percent gadolinium, slower cooling rate processing (i.e., casting) may be used for processing such alloys. However, rapid solidification techniques may be preferred in some embodiments to increase the supersaturation of gadolinium and decrease the size of the dispersoids, which thereby provides higher strength to the alloy.

The amount of zirconium present in the alloys of this invention, if any, may vary from about 0.4 to about 2.9 weight percent. In these alloys, zirconium is substituted for scandium in the $Al_3Sc$ dispersoids, forming Al3($Sc_x$,$Zr_{1-x}$), which controls the coarsening kinetics of the alloys. Since zirconium has high solubility in the $Al_3Sc$ dispersoids, zirconium can be substituted up to about 50% in the $Al_3(Sc_x,Zr_{1-x})$ dispersoids. Zirconium also forms a solid solution of zirconium in aluminum. While casting may be used with small zirconium additions, rapid solidification may be preferred for alloys having larger zirconium additions. However, rapid solidification techniques may be preferred in some embodiments to increase the supersaturation of zirconium and decrease the size of the dispersoids, which thereby provides higher strength to the alloy. The upper limit of about 2.9 weight percent zirconium was selected because atomization, the most common processing technique, can provide complete supersaturation of zirconium in aluminum only up to about 3 weight percent zirconium.

The amount of hafnium present in the alloys of this invention, if any, may vary from about 0.4 to about 30 weight percent. The amount of hafnium present depends on the solubility of hafnium in the $Al_3Sc$ dispersoids. Since hafnium has high solubility in the $Al_3Sc$ dispersoids, hafnium can be substituted up to about 50% in the $Al_3(Sc_x,Hf_{1-x})$ dispersoids. The Al—Hf system forms a peritectic reaction with the aluminum, resulting in $Al_3Hf$ dispersoids and a solid solution of hafnium in aluminum. Slower cooling rate techniques (i.e., casting) may be used for processing alloys having hafnium additions. However, rapid solidification techniques may be preferred in some embodiments to increase the supersaturation of hafnium and decrease the size of the dispersoids, which thereby provides higher strength to the alloy. While up to about 30 weight percent hafnium may be used in these alloys, in embodiments, only up to about 10 weight percent hafnium may be desired due to the steep increase in liquidus temperature that accompanies increasing hafnium concentrations.

The amount of yttrium present in the alloys of this invention, if any, may vary from about 0.4 to about 30 weight percent. The amount of yttrium present depends on the solubility of yttrium in the $Al_3Sc$ dispersoids. Since yttrium has high solubility in the $Al_3Sc$ dispersoids, yttrium can be substituted up to about 50% in the $Al_3(Sc_x,Y_{1-x})$ dispersoids. The Al—Y system forms an eutectic with aluminum, resulting in a solid solution of yttrium in aluminum and $Al_3Y$ dispersoids. Slower cooling rate techniques (i.e., casting) may be used for processing alloys having yttrium additions. However, rapid solidification techniques may be preferred in some embodiments to increase the supersaturation of yttrium and decrease the size of the dispersoids, which thereby provides higher strength to the alloy. While up to about 30 weight percent yttrium may be used in these alloys, in embodiments, only up to about 20 weight percent yttrium may be desired due to the increase in liquidus temperature that accompanies increasing yttrium concentrations.

The amount of vanadium present in the alloys of this invention, if any, may vary from about 0.2 to about 10 weight percent. The amount of vanadium present depends on the solubility of vanadium in the $Al_3Sc$ dispersoids. Vanadium has relatively lower solubility in the $Al_3Sc$ dispersoids than hafnium and yttrium, and vanadium can be substituted less than 50% in the $Al_3(Sc_x,V_{1-x})$ dispersoids. The Al—V system forms a peritectic reaction with the aluminum, resulting in $Al_3V$ dispersoids and a solid solution of vanadium in aluminum. Slower cooling rate techniques (i.e., casting) may be used for processing alloys having vanadium additions. However, rapid solidification techniques may be preferred in some embodiments to increase the supersaturation of vanadium and decrease the size of the dispersoids, which thereby provides higher strength to the alloy. While up to about 10 weight percent vanadium may be used in these alloys, in embodiments, only up to about 4 weight percent vanadium may be desired due to the increase in liquidus temperature that accompanies increasing vanadium concentrations.

The amount of niobium present in the alloys of this invention, if any, may vary from about 0.3 to about 10 weight percent. The amount of niobium present depends on the solubility of niobium in the $Al_3Sc$ dispersoids. Niobium has relatively lower solubility in the $Al_3Sc$ dispersoids than hafnium, yttrium and vanadium, and niobium can be substituted less than 50% in the $Al_3(Sc_x,Nb_{1-x})$ dispersoids. The Al—Nb system forms a peritectic reaction with the aluminum, resulting in $Al_3Nb$ dispersoids and a solid solution of niobium in aluminum. Slower cooling rate techniques (i.e., casting) may be used for processing alloys having niobium additions. However, rapid solidification techniques may be preferred in some embodiments to increase the supersaturation of niobium and decrease the size of the dispersoids, which thereby provides higher strength to the alloy. While up to about 10 weight percent niobium may be used in these alloys, in embodiments, only up to about 3 weight percent niobium may be desired due to the steep increase in liquidus temperature that accompanies increasing niobium concentrations.

The amount of nickel present in the alloys of this invention, if any, may vary from about 1.5 to about 25 weight percent. The amount of nickel present depends on the solubility of nickel in aluminum. Nickel has limited solubility in aluminum, but its solubility can be extended significantly by utilizing rapid solidification techniques. The Al—Ni system forms an eutectic with aluminum, resulting in $Al_3Ni$ dispersoids in a solid solution of nickel in aluminum. Slower cooling rate techniques (i.e., casting) may be used for processing alloys having nickel additions. However, rapid solidification techniques may be preferred in some embodiments to increase the supersaturation of nickel and decrease the size of the dispersoids, which thereby provides higher strength to the alloy. While up to about 25 weight percent nickel may be used in these alloys, in embodiments, only up to about 15 weight percent nickel may be desired due to the possible extension of the solid solubility of nickel in aluminum by rapid solidification techniques.

The amount of iron present in the alloys of this invention, if any, may vary from about 1.5 to about 20 weight percent. The amount of iron present depends on the solubility of iron in aluminum. Iron has limited solubility in aluminum, but its solubility can be extended significantly by utilizing rapid solidification techniques. The Al—Fe system forms an eutectic with aluminum, resulting in a mixture of $Al_3Fe$ dispersoids in a solid solution of iron in aluminum. Slower cooling rate techniques (i.e., casting) may be used for processing alloys having iron additions. However, rapid solidification techniques may be preferred in some embodiments to increase the supersaturation of iron and decrease the size of the dispersoids, which thereby provides higher strength to the alloy. Rapid solidification techniques can also form a metastable phase of $Al_6Fe$ through an eutectic reaction. While up to about 20 weight percent iron may be used in these alloys, in embodiments, only up to about 15 weight percent iron may be desired due to the possible extension of the solid solubility of iron in aluminum by rapid solidification techniques.

The amount of chromium present in the alloys of this invention, if any, may vary from about 1.0 to about 18 weight percent. The amount of chromium present depends on the solubility of chromium in aluminum. Chromium has limited solubility in aluminum, but its solubility can be extended significantly by utilizing rapid solidification techniques. The Al—Cr system forms a peritectic reaction with the aluminum, where the reaction of liquid and $Al_{11}Cr_2$ results in $Al_7Cr$ dispersoids and a solid solution of chromium in aluminum. Slower cooling rate techniques (i.e., casting) may be used for processing alloys having chromium additions. However, rapid solidification techniques may be preferred in some embodiments to increase the supersaturation of chromium and decrease the size of the dispersoids, which thereby provides higher strength to the alloy. While up to about 18 weight percent chromium may be used in these alloys, in embodiments, only up to about 10 weight percent chromium may be desired due to the possible extension of the solid solubility of chromium in aluminum by rapid solidification techniques.

The amount of manganese present in the alloys of this invention, if any, may vary from about 1.5 to about 25 weight percent. The amount of manganese present depends on the solubility of manganese in aluminum. Manganese has limited solubility in aluminum, but its solubility can be extended significantly by utilizing rapid solidification techniques. The Al—Mn system forms an eutectic with aluminum, resulting in $Al_6Mn$ dispersoids in a solid solution of manganese in aluminum. Slower cooling rate techniques (i.e., casting) may be used for processing alloys having manganese additions. However, rapid solidification techniques may be preferred in some embodiments to increase the supersaturation of manganese and decrease the size of the dispersoids, which thereby provides higher strength to the alloy. While up to about 25 weight percent manganese may be used in these alloys, in embodiments, only up to about 15 weight percent manganese may be desired due to the possible extension of the solid solubility of manganese in aluminum by rapid solidification techniques.

The amount of cobalt present in the alloys of this invention, if any, may vary from about 1.0 to about 25 weight percent. The amount of cobalt present depends on the solubility of cobalt in aluminum. Cobalt has limited solubility in aluminum, but its solubility can be extended significantly by utilizing rapid solidification techniques. The Al—Co system forms an eutectic with aluminum, resulting in $Al_9CO_2$ dispersoids in a solid solution of cobalt in aluminum. Slower cooling rate techniques (i.e., casting) may be used for processing alloys having cobalt additions. However, rapid solidification techniques may be preferred in some embodiments to increase the supersaturation of cobalt and decrease the size of the dispersoids, which thereby provides higher strength to the alloy. While up to about 25 weight percent cobalt may be used in these alloys, in embodiments, only up to about 10 weight percent cobalt may be desired due to the possible extension of the solid solubility of cobalt in aluminum by rapid solidification techniques.

In embodiments, there may be approximately 10-40 volume percent of fine $Al_3X$ based dispersoids present in order to provide the desired high strength at temperatures up to about 650° F. (343° C.). Some embodiments comprise about 15-20 volume percent of fine $Al_3X$ based dispersoids. However, depending upon the size of the dispersoids, higher or lower volume percents of $Al_3X$ based dispersoids may be present to provide balanced strength and ductility at temperatures up to about 650° F. (343° C.).

These aluminum alloys may be made in various forms (i.e., ribbon, flake, powder, etc.) by any rapid solidification technique that can provide supersaturation of elements, such as, but not limited to, melt spinning, splat quenching, spray deposition, vacuum plasma spraying, cold spraying, laser melting, mechanical alloying, ball milling (i.e., at room temperature), cryomilling (i.e., in a liquid nitrogen environment), spin forming, or atomization. Any processing technique utilizing cooling rates equivalent to or higher than about $10^{3}$° C./second is considered to be a rapid solidification technique for these alloys. Therefore, the minimum desired cooling rate for the processing of these alloys is about $10^{3}$° C./second, although higher cooling rates may be necessary for alloys having larger amounts of alloying additions. These aluminum alloys may also be made using various casting processes, such as, for example, squeeze casting, die casting, sand casting, permanent mold casting, etc., provided the alloy contains sufficient alloying additions.

Atomization may be the preferred technique for creating embodiments of these alloys. Atomization is one of the most common rapid solidification techniques used to produce large volumes of powder. The cooling rate experienced during atomization depends on the powder size and usually varies from about $10^{3}$ to about $10^{5}$° C./second. Helium gas atomization is often desirable because helium gas provides higher heat transfer coefficients, which leads to higher cooling rates in the powder. Fine size powders (i.e., about −325 mesh) may be desirable so as to achieve maximum supersaturation of alloying elements that can precipitate out during powder processing.

Cryomilling may be the preferred technique for creating other embodiments of these alloys. Cryomilling introduces oxynitride particles in the powder that can provide additional strengthening to the alloy at high temperatures by increasing the threshold stress for dislocation climb. Additionally, the nitride particles, when located on grain boundaries, can reduce the grain boundary sliding in the alloy by pinning the dislocation, which results in reduced dislocation mobility in the grain boundary.

Once the alloy composition (i.e., ribbon, flake, powder, etc.) is created, and after suitable vacuum degassing, the powder, ribbon, flake, etc. can be compacted in any suitable manner, such as, for example, by vacuum hot pressing or blind die compaction (where compaction occurs in both by shear deformation) or by hot isostatic pressing (where compaction occurs by diffusional creep).

After compaction, the alloy may be extruded, forged, or rolled to impart deformation thereto, which is important for achieving the best mechanical properties in the alloy. In embodiments, extrusion ratios ranging from about 10:1 to about 22:1 may be desired. In some embodiments, low extrusion ratios (i.e., about 2:1 to about 9:1) may be useful. Hot vacuum degassing, vacuum hot pressing and extrusion may be carried out at any suitable temperature, such as, for example, at about 572-842° F. (300-450° C.).

EXAMPLES

Various embodiments of the following novel alloy compositions (in weight percent) were produced using various powder metallurgy processes: about Al-8.4Ni-2.15Sc-8.8Gd-2.5Zr, about Al-8.4Ni-2.15Sc-8.8Gd-1.5Zr and about Al-8.4Ni-2.15Sc-4.1Gd-5.4Y. The powder metallurgy processes used for producing these alloys consisted of ingot fabrication, inert helium gas atomization, hot vacuum degassing, vacuum hot pressing, and extrusion. Alloying elements were mixed together and melted in an argon atmosphere at about 2100-2300° F. (1149-1260° C.) for about 15-60 minutes to form ingots of the above-noted compositions, each having very low oxygen content. The ingots were then further melted in an argon atmosphere at about 2400-2600° F. (1316-1427° C.) for about 15-60 minutes, and were then atomized via helium gas atomization to form spherical powders that also had very low oxygen content. The powders were then sieved to about −325 mesh. Thereafter, the powders were hot vacuum degassed at about 650-750° F. (343-399° C.) for about 4-15 hours to remove moisture and undesired gases from the powders. Next, the powders were compacted in a unidirectional vacuum hot press at about 650-750° F. (343-399° C.) for about 1-5 hours to create billets. The billets were then extruded at about 650-750° F. (343-399° C.) for about 5-30 minutes using extrusion ratios ranging from about 5:1 to about 25:1 to produce round bars of different sizes. Some non-limiting embodiments of each alloy were produced according to the processing parameters shown in Table I below.

TABLE I

| | Al—8.4Ni—2.15Sc—8.8Gd—2.5Zr | Al—8.4Ni—2.15Sc—8.8Gd—1.5Zr | Al—8.4Ni—2.15Sc—4.1Gd—5.4Y |
|---|---|---|---|
| Ingot fabrication | ~2200° F. (1204° C.)<br>~30 minutes | ~2200° F. (1204° C.)<br>~30 minutes | ~2200° F. (1204° C.)<br>~30 minutes |
| Helium gas atomization | ~2500° F. (1371° C.)<br>~30 minutes | ~2500° F. (1371° C.)<br>~30 minutes | ~2500° F. (1371° C.)<br>~30 minutes |
| Hot vacuum degassing | ~750° F. (399° C.)<br>~4 hours | ~700° F. (371° C.)<br>~15 hours | ~700° F. (371° C.)<br>~15 hours |
| Vacuum hot pressing | ~650° F. (343° C.)<br>~1 hour | ~700° F. (371° C.)<br>~5 hours | ~700° F. (371° C.)<br>~5 hours |
| Extrusion | ~700° F. (371° C.)<br>~30 minutes | ~750° F. (399° C.)<br>~5 minutes | ~750° F. (399° C.)<br>~5 minutes |
| Extrusion ratios | 22:1 | 10:1 and 22:1 | 10:1 and 22:1 |

Various properties (i.e., ultimate tensile strength, yield strength, percent elongation, percent reduction in area, and modulus) of these round bars were then tested in air. These same properties were also tested for some of the Al-8.4Ni-2.15Sc-8.8Gd-1.5Zr and Al-8.4Ni-2.15Sc-4.1Gd-5.4Y bars in high pressure (i.e., about 5 ksi) gaseous hydrogen. The Al-8.4Ni-2.15Sc-8.8Gd-1.5Zr and Al-8.4Ni-2.15Sc-4.1Gd-5.4Y alloys showed good strength and ductility in high pressure gaseous hydrogen, indicating that there is no hydrogen embrittlement of these alloys in such environments.

The Al-8.4Ni-2.15Sc-8.8Gd-2.5Zr, Al-8.4Ni-2.15Sc-8.8Gd-1.5Zr and Al-8.4Ni-2.15Sc-4.1Gd-5.4Y alloys all showed very high strengths in air for a range of temperatures up to about 650° F. (343° C.), as seen in FIGS. 2 and 3. As can be seen in FIG. 2, the Al-8.4Ni-2.15Sc-8.8Gd-2.5Zr, Al-8.4Ni-2.15Sc-8.8Gd-1.5Zr and Al-8.4Ni-2.15Sc-4.1Gd-5.4Y alloys, 10, 11, 12 respectively, are all significantly stronger than two commercial aluminum alloys (7075 and 6061) 13, 14 respectively. The Al-8.4Ni-2.15Sc-8.8Gd-1.5Zr and Al-8.4Ni-2.15Sc-4.1Gd-5.4Y alloys, 11, 12, had lower strengths than the Al-8.4Ni-2.15Sc-8.8Gd-2.5Zr alloy, 10, because they were processed at higher temperatures for longer amounts of time, as shown in Table I. This suggests that the alloys of this invention could be used to make stronger, lighter weight aerospace and space components.

Furthermore, the alloys of this invention also have a much higher specific strength (strength/density) in air than various other non-aluminum alloys, such as those materials currently utilized in rocket engines, as shown in FIG. 3. As can be seen, the specific strengths (strength/density) of the Al-8.4Ni-2.15Sc-8.8Gd-2.5Zr, Al-8.4Ni-2.15Sc-8.8Gd-1.5Zr and Al-8.4Ni-2.15Sc-4.1Gd-5.4Y alloys, 10, 11, 12 respectively, are higher than nickel based superalloy IN625 18, nitronic 40 steel 20, and 347 stainless steel 22, at least up to temperatures of about 425° F. (218° C.). It is believed that the processing of the Al-8.4Ni-2.15Sc-8.8Gd-1.5Zr and Al-8.4Ni-2.15Sc-4.1Gd-5.4Y alloys, 11, 12, can be further optimized to provide even greater strengths at temperatures up to about 650° F. (343° C.). Regardless, these results suggest that the alloys of this invention could be used to make significantly lighter weight rocket and aircraft structures, which would improve the thrust-to-weight ratio of the engines and reduce the cost for flights.

The alloys of the present invention can be used in monolithic form, or can contain continuous or discontinuous reinforcement materials (i.e., second phases) to produce metal-matrix composites. Suitable reinforcement materials include, but are not limited to, oxides, carbides, nitrides, oxynitrides, oxycarbonitrides, silicides, borides, boron, graphite, ferrous alloys, tungsten, titanium and/or mixtures thereof. Specific reinforcement materials include, but are not limited to, SiC, $Si_3N_4$, $Al_2O_3$, $B_4C$, $Y_2O_3$, $MgAl2O_4$, TiC, $TiB_2$ and/or mixtures thereof. These reinforcement materials may be present in volume fractions of up to about 50 volume percent, more preferably about 0.5-50 volume percent, and even more preferably about 0.5-20 volume percent.

The aluminum alloys of this invention may be used for various rocket and aircraft applications, such as for, but not limited to, structural jackets, turbo pump housings, turbine rotors, turbine rotor housings, impellers, valves, valve housings, injectors, nozzles, brackets, ducts/plumbing, and other structural components for rocket engines; and air inlet housings, stator assemblies, gearboxes, bearing housings, carbon seal housings, domes, covers, vanes and stators for jet engines. These alloys can also be used for other applications in jet engines, rocket engines and automobiles requiring high strengths at temperatures from about −420° F. (−251° C.) up to about 650° F. (343° C.).

Various embodiments of this invention have been described in fulfillment of the various needs that the invention meets. It should be recognized that these embodiments are merely illustrative of the principles of various embodiments of the present invention. Numerous modifications and adaptations thereof will be apparent to those skilled in the art without departing from the spirit and scope of the present invention. Thus, it is intended that the present invention cover all suitable modifications and variations as come within the scope of the appended claims and their equivalents.

What is claimed is:

1. An aluminum alloy comprising:

about 0.5-2.6 weight percent scandium;

about 2-10 weight percent nickel, about 0.4-2 weight percent zirconium, about 4-8.8 weight percent gadolinium; and the balance substantially aluminum, the alloy characterized by at least some $Ll_2$ $Al_3Sc$ fine and coherent precipitate dispersoids that are an ordered face centered cubic structure with scandium atoms located at the corners and aluminum atoms located on the cube faces and that are fine and coherent with the aluminum matrix microstructure produced by a rapid solidification technique utilizing a cooling rate of at least about $10^{3}$° C./second or higher and is compacted by vacuum hot pressing at about 343-399° C. to produce an alloy having a tensile strength of at least 118 ksi at 100° C.

2. The aluminum alloy of claim 1, wherein the alloy comprises an aluminum solid solution matrix and a plurality of dispersoids, the dispersoids comprising at least one of:

$Al_3Ni$, $Al_3Fe$, $Al_6Fe$, $Al_7Cr$, $Al_6Mn$, $Al_9CO_2$, and $Al_3X$, each $Al_3X$ dispersoid having an $Ll_2$ structure where X comprises scandium and at least one of: zirconium, gadolinium, hafnium, yttrium, niobium and vanadium.

3. The aluminum alloy of claim 1, wherein the alloy is substantially free of magnesium.

4. The aluminum alloy of claim 1, wherein the alloy is capable of being used at temperatures from about −420° F. (−251° C.) up to about 650° F. (343° C.).

5. The aluminum alloy of claim 1, wherein the aluminum alloy is used in at least one of: an aircraft component, a rocket component, and an automobile component.

6. The aluminum alloy of claim 5, wherein the rocket component comprises at least one of a structural jacket, a turbo pump housing, a turbine rotor, a turbine rotor housing, an impeller, a valve, a valve housing, an injector, a nozzle, a bracket, a duct, a plumbing component, and a structural rocket engine component.

7. The aluminum alloy of claim 5, wherein the aircraft component comprises at least one of an air inlet housing, a stator assembly a gearbox, a bearing housing, a carbon seal housing, a dome, a cover, a vane, and a stator.

8. The aluminum alloy of claim 1, wherein the alloy further comprises up to about 50 volume percent of a reinforcing second phase.

9. The aluminum alloy of claim 8, wherein the reinforcing second phase comprises at least one of: an oxide, a carbide, a nitride, an oxynitride, an oxycarbonitride, a silicide, a boride, a ferrous alloy, boron, graphite, tungsten, titanium, SiC, $Si_3N_4$, $Al_2O_3$, $B_4C$, $Y_2O_3$, $MgAl_2O_4$, TiC and $TiB_2$.

10. The aluminum alloy of claim 1, wherein the rapid solidification technique comprises at least one of: melt spinning, splat quenching, atomization, spray deposition, vacuum plasma spraying, cold spraying, laser melting, mechanical alloying, cryomilling, spin forming, and ball milling.

11. The aluminum alloy of claim 1, wherein the rapid solidification technique comprises at least the following steps:

creating an ingot having a predetermined composition;

melting the ingot;

atomizing the melted ingot to form a powder;

degassing the powder;

compacting the powder to create a billet;

hot working the billet into a predetermined form.

12. The aluminum alloy of claim 11, wherein the creating step occurs in an argon atmosphere at about 1149-1260° C. for about 15-60 minutes.

13. The aluminum alloy of claim 11, wherein the melting step occurs in an argon atmosphere at about 1316-1427° C. for about 15-60 minutes.

14. The aluminum alloy of claim 13, wherein the degassing step comprises hot vacuum degassing the powder at about 343-399° C. for about 1-5 hours.

15. The aluminum alloy of claim 11, wherein the hot working step occurs at about 343-399° C. for about 5-30 minutes.

16. An aluminum alloy comprising:

about 0.6-2.9 weight percent scandium;

about 1.5-25 weight percent nickel;

at least one of:

about 0.4-20 weight percent gadolinium, about 0.4-2.9 weight percent zirconium, about 0.4-30 weight percent hafnium,
about 0.3-10 weight percent niobium,
about 0.2-10 weight percent vanadium, and
about 0.4-30 weight percent yttrium; and the balance substantially aluminum, the alloy characterized by at least some fine and coherent $Ll_2Al_3Sc$ precipitate dispersoids, that are an ordered face centered cubic structure with scandium atoms located at the corners and aluminum atoms located on the cube faces and that are fine and coherent with the aluminum matrix microstructure produced by a rapid solidification technique utilizing a cooling rate of at least about $10^{3}$° C./second or higher and is compacted by vacuum hot pressing at about 343-399° C. to produce an alloy having a tensile strength of at least 118 ksi at 100° C.

17. The aluminum alloy of claim 16, wherein the alloy comprises an aluminum solid solution matrix and a dispersion of $Al_3Ni$ and $Al_3X$, the $Al_3X$ having an $Ll_2$ structure where X comprises scandium and at least one of gadolinium, zirconium, hafnium, niobium, vanadium and yttrium.

18. The aluminum alloy of claim 16, wherein the alloy is substantially free of magnesium.

19. The aluminum alloy of claim 16, wherein the alloy is capable of being used at temperatures from about −420° F. (−251° C.) up to about 650° F. (343° C.).

20. The aluminum alloy of claim 16, wherein the aluminum alloy is used in at least one of: an aircraft component, a rocket component, and an automobile component.

21. The aluminum alloy of claim 20, wherein the rocket component comprises at least one of a structural jacket, a turbo pump housing, a turbine rotor, a turbine rotor housing, an impeller, a valve, a valve housing, an injector, a nozzle, a bracket, a duct, a plumbing component, and a structural rocket component.

22. The aluminum alloy of claim 20, wherein the aircraft component comprises at least one of an air inlet housing, a stator assembly, a gearbox, a bearing housing, a carbon seal housing, a dome, a cover, a vane, and a stator.

23. The aluminum alloy of claim 16, comprising:
about 1-2.9 weight percent scandium;
about 6-10 weight percent nickel;
at least one of:
about 2-10 weight percent gadolinium,
about 0.5-2.9 weight percent zirconium,
about 6-12 weight percent hafnium,
about 1-6 weight percent niobium,
about 1-5 weight percent vanadium, and
about 1-8 weight percent yttrium; and
the balance substantially aluminum.

24. The aluminum alloy of claim 23, comprising:
about 2.16 weight percent scandium;
about 8.4 weight percent nickel;
at least one of:
about 4.1-8.8 weight percent gadolinium,
about 1.5-2.5 weight percent zirconium,
about 8.0-11.5 weight percent hafnium,
about 2.5-5.0 weight percent niobium,
about 2.0-3.2 weight percent vanadium, and
about 2.5-6.5 weight percent yttrium; and
the balance substantially aluminum.

25. An aluminum alloy comprising at least one of the following compositions, in weight percent:
about Al-(6-10)Ni-(1-2.9)Sc-(6-10)Gd-(0.5-2.9)Zr;
about Al-(6-10)Ni-(1-2.9)Sc-(6-10)Gd-(1-4)Y;
about Al-(6-10)Ni-(1-2.9)Sc-(2-6)Gd-(4-8)Y;
about Al-(6-10)Ni-1-2.9)Sc-(6-12)Hf-(0.5-2.9)Zr;
about Al-(6-10)Ni-(1-2.9)Sc-(6-12)Hf-(3-7)Gd;
about Al-(6-10)Ni-(1-2.9)Sc-(6-12)Hf-(2-6)Y;
about Al-(6-10)Ni-(1-2.9)Sc-(4-9)Y-(0.5-2.9)Zr;
about Al-(6-10)Ni-(1-2.9)Sc-(1-6)Nb-(0.5-2.9)Zr;
about Al-(6-10)Ni-(1-2.9)Sc-(6-12)Hf-(1-6)Nb;
about Al-(6-10)Ni-(1-2.9)Sc-(6-12)Hf-(1-5)V;
about Al-(6-10)Ni-(1-2.9)Sc-(1-6)Nb-(1-5)V;
about Al-(6-10)Ni-(1-2.9)Sc-(0.5-2.9)Zr-(1-5)V;
about Al-8.4Ni-2.15Sc-8.8Gd-1.5Zr;
about Al-8.4Ni-2.15Sc-8.5Gd-2.5Y;
about Al-8.4Ni-2.15Sc-4.1Gd-5.4Y;
about Al-8.4Ni-2.15Sc-11.5Hf-1.5Zr;
about Al-8.4Ni-2.15Sc-9.8Hf-1.5Zr;
about Al-8.4Ni-2.15Sc-9.0Hf-4.5Gd;
about Al-8.4Ni-2.15Sc-8.5Hf-3.0Y;
about Al-8.4Ni-2.15Sc-6.5Y-1.5Zr;
about Al-8.4Ni-2.15Sc-9.5Hf-2.5Nb;
about Al-8.4Ni-2.15Sc-8.0Hf-2.0V;
about Al-8.4Ni-2.15Sc-2.5Nb-3.2V; and about Al-8.4Ni-2.15Sc-2.5Zr-3.2V, the alloy characterized by at least some fine and coherent $Ll_2$ $Al_3Sc$ precipitate dispersoids, that are an ordered face centered cubic structure with scandium atoms located at the corners and aluminum atoms located on the cube faces and that are fine and coherent with the aluminum matrix microstructure and is compacted by vacuum hot pressing at about 343-399° C. to produce an alloy having a tensile strength of at least 118 ksi at 100° C.

26. An aluminum alloy comprising the following composition, in weight percent, about Al-8.4Ni-2.15Sc-8.8Gd-2.5Zr, the alloy characterized by at least some $Ll_2$ $Al_3Sc$ fine and coherent precipitate dispersoids, that are an ordered face centered cubic structure with scandium atoms located at the corners and aluminum atoms located on the cube faces and that are fine and coherent with the aluminum matrix microstructure and is compacted by vacuum hot pressing at about 343-399° C. to produce an alloy having a tensile strength of at least 118 ksi at 100° C.

27. The aluminum alloy of claim 26, wherein the alloy comprises an aluminum solid solution matrix, a plurality of $Al_3$(Sc,Gd,Zr) dispersoids having an $Ll_2$ structure, and a plurality of $Al_3Ni$ dispersoids.

28. The aluminum alloy of claim 26, wherein the alloy is substantially free of magnesium.

29. The aluminum alloy of claim 26, wherein the alloy is capable of being used at temperatures from about −420° F. (−251° C.) up to about 650° F. (343° C.).

30. The aluminum alloy of claim 26, wherein the alloy further comprises up to about 50 volume percent of a reinforcing second phase.

31. The aluminum alloy of claim 30, wherein the reinforcing second phase comprises at least one of: an oxide, a carbide, a nitride, an oxynitride, an oxycarbonitride, a silicide, a boride, a ferrous alloy, boron, graphite, tungsten, titanium, SiC, $Si_3N_4$, $Al_2O_3$, $B_4C$, $Y_2O_3$, $MgAl_2O_4$, TiC and $TiB_2$.

32. The aluminum alloy of claim 26, wherein the alloy is produced by a rapid solidification technique utilizing a cooling rate of at least about $10^{3}$° C./second or higher.

33. The aluminum alloy of claim 32, wherein the rapid solidification technique comprises at least the following steps:
creating an ingot having a predetermined composition;
melting the ingot;
atomizing the melted ingot to form a powder;
degassing the powder;
compacting the powder to create a billet; and
hot working the billet into a predetermined form.

34. The aluminum alloy of claim 33, wherein the creating step occurs in an argon atmosphere at about 1149-1260° C. for about 15-60 minutes.

35. The aluminum alloy of claim 33, wherein the melting step occurs in an argon atmosphere at about 1316-1427° C. for about 15-60 minutes.

36. The aluminum alloy of claim 33, wherein the degassing step comprises hot vacuum degassing the powder at about 343-399° C. for about 4-15 hours.

37. The aluminum alloy of claim 33, wherein the hot working step occurs at about 343-399° C. for about 5-30 minutes.

38. The aluminum alloy of claim 26, wherein the aluminum alloy is used in at least one of: an aircraft component, a rocket component, and an automobile component.

39. The aluminum alloy of claim 38, wherein the rocket component comprises at least one of a structural jacket, a turbo pump housing, a turbine rotor, a turbine rotor housing, an impeller, a valve, a valve housing, an injector, a nozzle, a bracket, a duct, a plumbing component, and a structural rocket engine component.

40. The aluminum alloy of claim 38, wherein the aircraft component comprises at least one of an air inlet housing, a stator assembly, a gearbox, a bearing housing, a carbon seal housing, a dome, a cover, a vane, and a stator.

* * * * *